United States Patent [19]

Puhak et al.

[11] 4,211,465

[45] Jul. 8, 1980

[54] MEANS FOR CONTROLLING DIELECTRIC FLOW IN AN ELECTRON TUBE BASE

[75] Inventors: Peter G. Puhak, Seneca Falls; John D. Bilynsky, Auburn; Fred L. Sorensen, Waterloo, all of N.Y.

[73] Assignee: GTE Products Corporation, Stamford, Conn.

[21] Appl. No.: 23,352

[22] Filed: Mar. 23, 1979

[51] Int. Cl.[3] ..... H01R 13/46

[52] U.S. Cl. ..... 339/144 T; 339/111

[58] Field of Search ..... 339/163 T, 144 T, 145 T, 339/111, 275 R; 313/318, 325

[56] References Cited

U.S. PATENT DOCUMENTS

| | | | |
|---|---|---|---|
| 3,278,886 | 10/1966 | Blumenberg et al. | 339/111 X |
| 4,076,366 | 2/1978 | Wardell et al. | 339/144 T |
| 4,152,040 | 5/1979 | Rusinico | 339/144 T |

*Primary Examiner*—Roy Lake
*Assistant Examiner*—Eugene F. Desmond
*Attorney, Agent, or Firm*—William H. McNeill

[57] ABSTRACT

Structural means are provided in an electron tube base for expeditiously controlling the flow of dielectric adhesive material relative to designated lead positions therein. This is accomplished by barrier means in the form of a centralized rim, extending from the crown portion of the base, which isolates the low voltage leads from the flow of dielectric material. In conjunction therewith, a trough-like channel is formed in the floor of the base flange to expedite flow of the dielectric material from the central cavity of the base to the vicinity of the high voltage leads.

8 Claims, 4 Drawing Figures

MEANS FOR CONTROLLING DIELECTRIC FLOW IN AN ELECTRON TUBE BASE

TECHNICAL FIELD

This invention relates to electron tube bases and more particularly to tube bases for cathode ray tubes employing high voltage differentials between closely-spaced connective leads wherein the flow of dielectric material within the base is controlled by discrete means.

BACKGROUND ART

It is conventional for many state-of-the-art cathode ray tubes, such as those employed in color television applications, to have small neck diameters and integrally size-related closure portions. The plurality of connective leads or pins protruding from the closure are usually oriented in a pin-circle array evidencing rather close inter-lead spacings because of the restrictive circumferential arrangement. Since high voltage differentials are existent between certain of the leads, it has been conventional practice to insulate the leads in the base, especially the high voltage ones, by surrounding them with a viscous dielectric material introduced into the base when such is positioned on the closure portion of the tube.

A common procedure for introducing the dielectric material into the base is by pressurized application through the terminal aperture in the substantially axially-oriented hollow crown of the base, that part which spatially encompasses and protects the sealed exhaust tubulation of the tube. The pressurized injection of the dielectric forces it inwardly through the space between the tubulation and the internal wall of the crown to the wafer or flange region of the base. There it is intended to flow around the leads, the high voltage ones in particular, to effect electrical insulation therearound.

Because of minute lead positioning deviations inherent in stem manufacturing, it has been a practice to incorporate pin circle tolerances in the base by slightly increasing the diameter of certain apertures in the base wafer or flange, usually those diametrically opposed to the high voltage lead-receiving apertures. While the incorporation of this lead tolerance feature in the base minimizes possible binding when assembling the base to the tube, there are occasions when a problem is evidenced. In endeavoring to achieve desired encompassment of the high voltage leads with the dielectric material, the pressurized dielectric is sometimes squeezed out along the pins in the substantially opposed larger-sized apertures.

DISCLOSURE OF THE INVENTION

In one aspect of the invention expeditious means are provided within the base of an electron tube, such as that applied to the closure portion of a cathode ray tube, wherein the flow of dielectric material is controlled by cooperating configurations integrated therein.

An exemplary base utilizing the invention is one of wafer-type construction wherein the sealed exhaust tubulation of the tube is spatially enclosed within a substantially centrally located hollow crown. Integral therewith and extending outward therefrom is a substantially planar circular flange containing an array of apertures spaced to receive the connective leads of the tube. The base is adhered to the closure portion of the tube by a dielectric material which by one procedure is pressure introduced through a terminal aperture in the crown.

The invention relates to discrete cooperating configurations formed in the interfacial surface of the flange, that portion being adjacent to the closure surface of the tube, to control the flow of the dielectric in that region. Barrier means in the form of a centralized rim of substantially uniform height is fashioned to upstand from the floor of the interfacial surface of the flange as an integral continuation of the internal wall structure of that portion of the crown defining the open end thereof. This rim construction, which extends in a circular manner partially therearound, is of a height to abut the closure of the tube when such is located thereon. Thus, the rim-like barrier effectively prevents the flow of the dielectric material from the cavity to the vicinity of certain designated lead-receiving apertures in the array located peripherally therebeyond.

In conjunction with the aforedescribed barrier, at least one cooperating trough-like channel structure is formed in the floor of the interfacial flange surface in the region of the rim, such being in the vicinity of other designated lead-receiving aperture positions. This channel, which is substantially radially oriented, opens into the cavity of the crown. Thus, it expedites the flow of the dielectric material from the cavity to the vicinity of the other designated aperture positions, and enhances the desirable application of the dielectric around the respective leads accommodated thereat.

BEST MODE FOR CARRYING OUT THE INVENTION

For a better understanding of the present invention, together with the advantages and capabilities thereof, reference is made to the following specification and appended claims in connection with the aforedescribed drawings.

Figure 1:
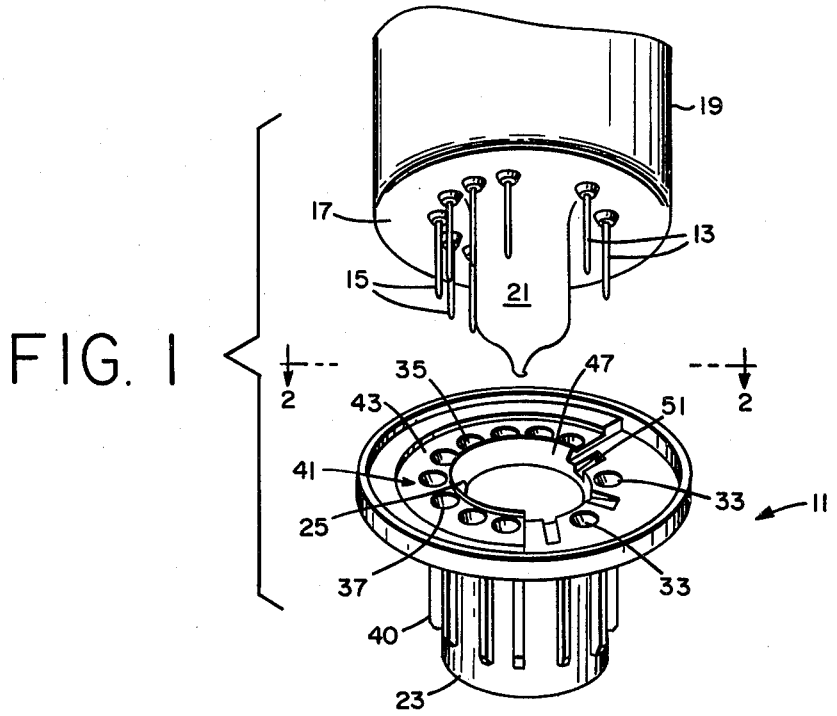
FIG. 1 is an exploded perspective of the tube base illustrating the invention therein and the tube closure portion associated therewith.

Referring now to the drawings, there is shown in FIG. 1 an exploded presentation wherein an exemplary plural-apertured electron tube base 11, incorporating the invention, is oriented to receive a conventional terminal array of connective pins or leads 13 and 15 protruding from the closure portion 17 of a tube, such as a cathode ray tube 19. Also projecting from the closure portion, in a substantially axial orientation, is the sealed exhaust tubulation 21 which is also suitably accommodated by the structure of the base.

In greater detail and with particular reference to the drawings, the base 11 is comprised of an axial hollow thimble-like crown 23 formed of a substantially cylindrical wall 24 evidencing a tapered open end 25 and an opposed terminal end 27 having an aperture 29 therein. The internal cavity defined within the crown is dimensioned to spatially encompass the sealed tubulation 21. An annular flange 31 integrally joined to the crown 23 extends outward therefrom in a normal manner at the open end 25 thereof. This flange is traversed by an annular array of lead-receiving aperture positions 33, 35, 37. The leading edges 38 of the respective apertures are conventionally tapered to aid in insertion of the connective leads 13, 15. The outer surface of the crown 23 has formed thereon a plurality of spaced apart ribs 40, extending longitudinally from the flange 31 toward the terminal end 27 of the crown to provide a succession of grooves wherein the array of leads, traversing the apertures, are positioned.

The flange portion 31 has an interfacial surface 41 which is that surface adjacent the tube closure portion 17. This interfacial surface has a floor 43 wherefrom a raised annular seating ledge 45 is formed to extend at least partially circumferentially therearound in the region beyond the array of apertures to provide seating means for the tube closure portion 17.

When the base 11 is assembled to the closure portion of the tube 19, a viscous dielectric material 39, such as a RTV silicone rubber composition, which substantially hardens upon curing, is introduced into the base. In this instance, the dielectric material is pressure injected into the cavity of the crown 23 via aperture 29, and is thence forced along the spacing between the tubulation 21 and the wall 24 of the crown toward the flange 31.

Figure 2:
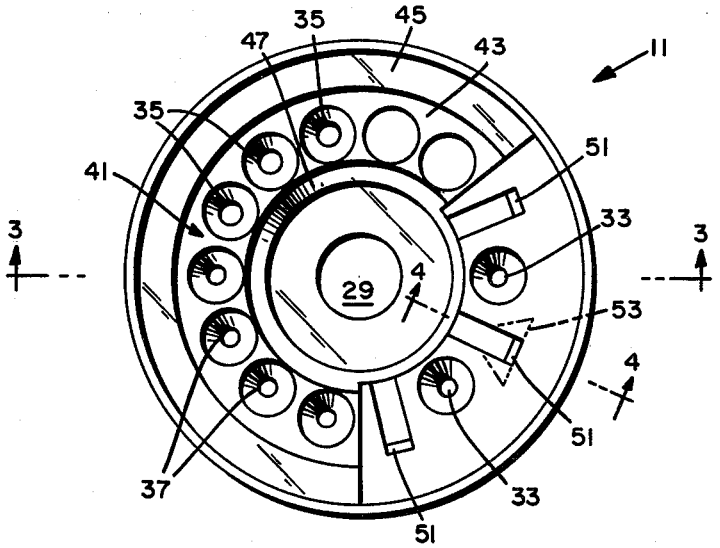
FIG. 2 is a plan view of the interfacial area of the base taken along the line 2—2 of FIG. 1.
Figure 3:
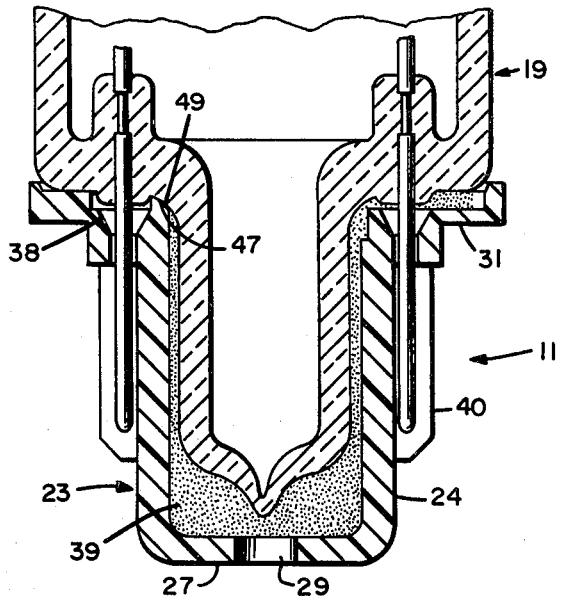
FIG. 3 is a sectional view showing the base-tube assembly taken along the line 3—3 of FIG. 2.
Figure 4:
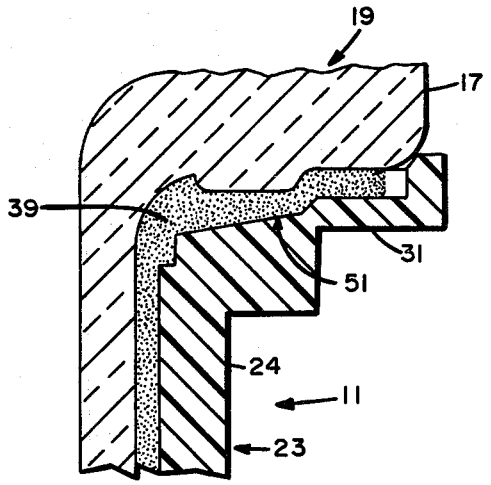
FIG. 4 is an enlarged partial sectional view of the assembly taken along the line 4—4 of FIG. 2.

As previously mentioned, it is desired to have the high voltage leads of the tube surrounded by dielectric material in the base to minimize the possibility of inter-lead arcing. In referring to FIGS. 1 and 2, the high voltage leads 13 are directed into apertures 33 in the base 11, and the tube leads 15 carrying lesser potentials are positioned in aperture groupings 35 and 37. While all leads are usually of like diameters, it has been a practice in some instances to slightly increase the diameter of several of the apertures in the pin circle of the base to compensate for possible minute lead positioning deviations inherent in stem manufacturing. In FIG. 2, base apertures 35 illustrate such enlargement. It is important to surround or engulf the high voltage leads 13 with the dielectric material 39 as an arc preventative measure, but the lower potential carrying leads 15 do not require the added insulation, and since the pressurized dielectric is apt to squeeze out around the leads in the larger diametered apertures 35, it is well to keep the dielectric material away from the vicinity of the lower potential leads 15.

The invention is specifically directed to means for controlling the flow of the dielectric material 39 within the structure of the base 11 when such is attached to the closure portion of the tube. The invention relates to configurations formed in the interfacial surface of the base. One such configuration is a barrier means in the form of a substantially uniform arcuate rim 47 extending partially around the crown 23, being an extension of the wall structure of the crown, and having a height above the interfacial floor 43 of the flange to substantially abut the closure portion of the tube 17 when such is mated therewith. The terminal surface 49 of the rim 47 is shaped to be compatible with the abutting surface of the tube closure portion 17. In the example shown, the barrier rim is of an arcuate length extending more than the semicircular distance therearound. As such, it shieldw particularly the larger diametered aperture positions 35 and also the regular aperture positions 37, and thus prevents the flow of the dielectric material to the vicinity of the designated low voltage leads accommodated to those respective apertures.

Another configuration of the invention is located in the interfacial region which is devoid of the arcuate barrier, this being in the vicinity of the designated high voltage lead receiving apertures 33. This configuration is at least one trough-like channel structure 51, formed in the floor 43 of the interfacial surface of the flange, in substantially radial orientation opening into the cavity of the crown 23. In the embodiment shown in FIGS. 1 and 2, a plurality of three substantially similar channels 51 are delineated as being oriented in the spatial region between and adjacent the apertures 33. The channels are sloped in a manner whereby the maximum depth of the trough is at the opening into the cavity. Thus, the flow of the dielectric material is faciliated in a manner to expeditiously surround the high voltage leads 13 to provide the insulation desired. As phantomed at 53 in FIG. 2, the spread of the flow of the viscous dielectric material can be further facilitated by progressively increasing the width of the channel as it slopes from the cavity of the crown 23 toward the periphery of the flange 31.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The invention provides discrete structural means for an electron tube base, particularly relating to the wafer-type CRT bases for tubes employing high voltage connective leads which are desirably fully surrounded by a viscous dielectric material. The barrier and channel structural innovations expeditiously cooperate to direct the flow of the dielectric within the base to achieve the desired results without affecting the conventional procedure of pressure injecting the dielectric substance into the crown.

We claim:

1. In an electron tube base employing a dielectric material therein contiguous to the closure portion of the tube wherefrom a sealed exhaust tubulation and a plurality of surrounding connective leads extend in parallel relationship, said base having an axial hollow thimble-like crown formed of a substantially cylindrical wall evidencing open and opposed terminal ends and an annular flange extending outwardly in a manner normal to said crown at said open end thereof, said crown defining an internal cavity dimensioned to spatially encompass said tubulation, the terminal end of said crown having an aperture therethrough to provide means for introducing said dielectric material into said cavity, said flange being traversed by an array of apertures to accommodate the positioning of said leads therethrough, said flange having an interfacial surface adjacent said tube closure portion, said interfacial surface having a floor wherefrom a raised annular seating ledge is formed to extend at least partially circumferentially therearound in the region beyond said aperture array to provide seating means for said closure portion, said interfacial surface being further configurated in a manner comprising: barrier means formed adjacent certain designated lead-receiving aperture positions to prevent the flow of said dielectric material from said cavity to the vicinity of said certain designated aperture positions; and in the region devoid of said barrier at least one channel means formed in the floor of said interfacial surface adjacent other designated lead-receiving aperture positions to facilitate the flow of said dielectric material from said cavity to the vicinity of said other designated aperture positions.

2. The electron tube base according to claim 1 wherein said barrier means is formed as an extension of the wall structure of said hollow crown, said wall extension being of a height above said interfacial floor to substantially abut the closure portion of said tube when mated therewith, said barrier being shaped to be compatible with the abutting surface of said closure portion.

3. The electron tube base according to claim 2 wherein said barrier means is formed as a substantially uniform arcuate rim extending partially around the wall of said crown.

4. The electron tube base according to claim 3 wherein the length of said arcuate rim is greater than semicircular definition.

5. The electron tube base according to claim 1 wherein said channel means is at least one trough-like structure formed in the floor of said interfacial surface in substantially radial orientation opening into said cavity.

6. The electron tube base according to claim 4 wherein said channel means is oriented in said floor in substantially the spatial region between aperture positions.

7. The electron tube base according to claim 4 wherein said channel means is sloped in a manner whereby the maximum depth of said channel is at the opening into said cavity.

8. The electron tube base according to claim 4 wherein said channel evidences a substantially progressive increase in width as it advances from said cavity into said flange.

* * * * *